US008844071B1

(12) United States Patent
Alexander

(10) Patent No.: US 8,844,071 B1
(45) Date of Patent: Sep. 30, 2014

(54) CRIB TRANSFORMER BED

(71) Applicant: David Samuel Alexander, Brooklyn, NY (US)

(72) Inventor: David Samuel Alexander, Brooklyn, NY (US)

( * ) Notice: Subject to any disclaimer, the term of this patent is extended or adjusted under 35 U.S.C. 154(b) by 0 days.

(21) Appl. No.: 13/740,370

(22) Filed: Jan. 14, 2013

Related U.S. Application Data

(60) Provisional application No. 61/588,210, filed on Jan. 19, 2012.

(51) Int. Cl.
*A47D 7/00* (2006.01)

(52) U.S. Cl.
USPC ..... 5/93.2; 5/1; 5/2.1; 5/11; 5/93.1; 5/95; 5/96

(58) Field of Classification Search
USPC ..... 5/1, 2.1, 11, 93.1, 93.2, 95, 96
See application file for complete search history.

(56) References Cited

U.S. PATENT DOCUMENTS

| | | | | | |
|---|---|---|---|---|---|
| 1,391,566 | A | * | 9/1921 | Musselman | 5/2.1 |
| 3,535,717 | A | * | 10/1970 | Mulder | 5/93.1 |
| 4,103,373 | A | | 8/1978 | Luedtke et al. | |
| 4,450,597 | A | | 5/1984 | Hull | |
| 4,525,883 | A | * | 7/1985 | Necowitz | 5/93.2 |
| 4,555,821 | A | | 12/1985 | Page | |
| 4,811,436 | A | | 3/1989 | Schwartz | |
| 5,067,183 | A | | 11/1991 | Urquiola | |
| 5,077,846 | A | * | 1/1992 | Wheeler et al. | 5/93.2 |
| 5,173,974 | A | * | 12/1992 | Proano et al. | 5/93.2 |
| 5,715,551 | A | * | 2/1998 | Proano et al. | 5/93.2 |
| 5,754,995 | A | | 5/1998 | Behrendt | |
| 5,867,849 | A | * | 2/1999 | Pontrello | 5/2.1 |
| 6,594,834 | B2 | * | 7/2003 | Fenty et al. | 5/93.2 |
| 6,845,530 | B2 | * | 1/2005 | Briere | 5/93.2 |
| 6,877,824 | B2 | | 4/2005 | Winkless | |
| 7,207,076 | B2 | | 4/2007 | Gardner | |
| 7,376,987 | B2 | * | 5/2008 | Barnes | 5/93.2 |
| 2008/0263764 | A1 | * | 10/2008 | Jones | 5/93.2 |
| 2011/0179568 | A1 | * | 7/2011 | Jones | 5/93.2 |
| 2012/0102641 | A1 | * | 5/2012 | Srour et al. | 5/93.1 |

* cited by examiner

*Primary Examiner* — William Kelleher
*Assistant Examiner* — Duoni Pan
(74) *Attorney, Agent, or Firm* — RG Patent Consulting, LLC; Rachel Gilboy

(57) ABSTRACT

A self-contained convertible bed and storage system is disclosed herein to accommodate the needs of various users by transforming into an assembly fit either for crib use or an assembly fit for bed use with storage capabilities. The self-contained convertible bed and storage system preferably comprises: a crib framework assembly; a mattress platform assembly; and a support system having a fourfold corner-support-system, a front sidewall support, and a rear sidewall support. The crib framework assembly and the mattress platform assembly are releasably attached one to another to form a multi-purpose changeable bed arrangement. The crib framework assembly, mattress platform assembly, support system may be arranged in combination to form a crib. Alternatively, the mattress platform assembly and support system may be arranged in combination to form a bed.

20 Claims, 5 Drawing Sheets

CRIB TRANSFORMER BED

CROSS-REFERENCE TO RELATED APPLICATION

The present application is related to and claims priority from prior provisional application Ser. No. 61/588,210, filed Jan. 19, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of convertible beds and more specifically relates to self-contained convertible bed and storage systems for multi-purpose changeable bed arrangements and storage compartment access.

2. Description of the Related Art

Many individuals in modern society rely upon one type of bed or another for resting, napping, and sleeping through a night. As a person's body changes with time, so do his or her requirements for a bed. At the beginning of life, an infant requires not only the support of a firm mattress but also the support of side rails and/or crib walls to prevent the infant from rolling off the bed and onto the floor. As the infant grows into an older child, he or she generally learns to stay atop the bed when sleeping. Also, his or her body usually lengthens beyond the capacity of a crib. Thus, a larger, and usually less confining, bed is required to fit the older child as he or she grows into adolescence and adulthood. Obtaining several beds to accommodate the different stages of a person's development may be costly and time-consuming. Storing bedding such as blankets, sheets, and pillows for these various beds can consume valuable space as well.

Various attempts have been made to solve the above-mentioned problems such as those found in U.S. Pat. Nos. 4,450,597; 5,067,183; 4,555,821; 4,103,373; 7,207,076; 4,811,436; 5,754,995; and 6,877,824. This prior art is representative of convertible beds. None of the above inventions and patents, taken either singly or in combination, is seen to describe the invention as claimed.

Ideally, a self-contained convertible bed and storage system should be compact, versatile, aesthetically pleasing, easily manipulated, and, yet, would operate reliably and be manufactured at a modest expense. Thus, a need exists for a reliable self-contained convertible bed and storage system to provide a single unit capable of readily transforming into various bed configurations and offer easy-access storage compartments and to avoid the above-mentioned problems.

BRIEF SUMMARY OF THE INVENTION

In view of the foregoing disadvantages inherent in the known convertible bed art, the present invention provides a novel Crib Transformer Bed system. The general purpose of the present invention, which will be described subsequently in greater detail, is to provide a single unit capable of readily transforming into various bed configurations and offering easy-access storage compartments.

A self-contained convertible bed and storage system is disclosed herein preferably comprising: a crib framework assembly; a mattress platform assembly; and a support system having a fourfold corner-support-system (right front, right rear, left front, and left rear), a front sidewall support, and a rear sidewall support. In preferred embodiments, the crib framework assembly and the mattress platform assembly are releasably attached one to another to form a multi-purpose changeable bed arrangement. The crib framework assembly, mattress platform assembly, corner-support-system, front sidewall support, and rear sidewall support may be arranged in combination to form a crib. Alternatively, the mattress platform assembly, corner-support-system, front sidewall support, and rear sidewall support may be arranged in combination to form a bed. When in a bed configuration, the internal voids of the mattress platform assembly may be accessed in order that a user may conveniently store any storable items.

In the present embodiment, the crib framework assembly comprises four substantially vertical side panels (front, rear, right, and left) and four substantially upright posts (right front, left front, right rear, and left rear). Each vertical side panel is preferably made up of a horizontal upper rail and a horizontal lower rail separated by the length of the vertical side slats to which both rails are attached. These vertical side panels are releasably attached to, and therefore supported by and suspended between, the four upright posts, such that the crib framework assembly takes on the shape of a rectangular crib. In the present invention, the front panel of the crib framework assembly comprises an upper member that is preferably hingably attached to a lower member such that the upper member acts in the capacity of a gate to provide easy access to the interior of the crib.

The self-contained convertible bed and storage system further comprises a mattress platform assembly including a right mattress frame; a substantially horizontal right base; a left mattress frame; a substantially horizontal left base; a right mattress tray; a left mattress tray; a right mattress; and a left mattress in combination. The right and left mattress frames of the present embodiment preferably mirror one another and are hingably attached one to another. Both include four substantially vertical sidewalls (front, rear, outer, and inner). Similarly to the right and left mattress frames, the right and left bases mirror each other—the right preferably including an inner surface an outer surface, and an inner void, and the left preferably including an inner facing an outer facing, and an inner volume. In the present invention, the right and left mattresses are preferably supported for use by the right and left mattress trays, respectively. These mattress trays are also hingably attached such that when one or another tray is raised, the internal voids of the mattress platform assembly may be accessed. The mattresses of the mattress platform assembly provide comfort for a user resting upon them. To accommodate the needs of various users, the mattress platform assembly of the present invention may be collapsed into an assembly fit for either crib use or expanded into an assembly fit for bed use.

The crib framework assembly and the mattress platform assembly may be simultaneously or individually supported by at least one of: the corner-support-system; the front sidewall support; or the rear sidewall support, or by a combination thereof. The corner-support-system comprises four 90-degree corner supports (right front, right rear, left front, and left rear). The front and rear sidewall supports are linear in design to support the side panels of the crib framework assembly and/or the sidewalls of the mattress platform assembly. Each of these support components comprises at least one position-adjustable inner support shelf and a plurality of corresponding inner support shelf notches. The mattress platform assembly may be supported off the ground by at least one of these inner support shelves. The repositionable nature of the inner support shelves allows the height of the mattress platform assembly to be adjusted by a user.

A method of using the self-contained convertible bed and storage system is also described herein preferably comprising the steps of: arranging a corner-support-system, a front sidewall support, and a rear sidewall support in such a manner as to support a crib framework assembly and a collapsed mattress platform assembly; assembling a mattress platform assembly; placing the mattress platform assembly within the support system arrangement; assembling the crib framework assembly on top of the support system arrangement; and using the self-contained convertible bed and storage system as a crib.

The method preferably further comprises the steps of: disassembling the crib framework assembly and removing it from the support system arrangement when the crib is no longer needed; expanding the mattress platform assembly; rearranging the support system arrangement in such a manner as to support an expanded mattress platform assembly and then placing the expanded mattress platform assembly within the new arrangement; and using the self-contained convertible bed and storage system as a bed. Furthermore, the method of use comprises the step of accessing the inner volume and/or inner void as needed for storing storable items within the self-contained convertible bed and storage system.

The present invention holds significant improvements and serves as a convertible bed system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Crib Transformer Bed, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a convertible bed device and more particularly to a Crib Transformer Bed as used to improve the efficiency of transforming a bed into various configurations while simultaneously offering easily-accessible storage compartments. Crib Transformer Bed may comprise bunk beds and other types of beds.

Figure 1A:
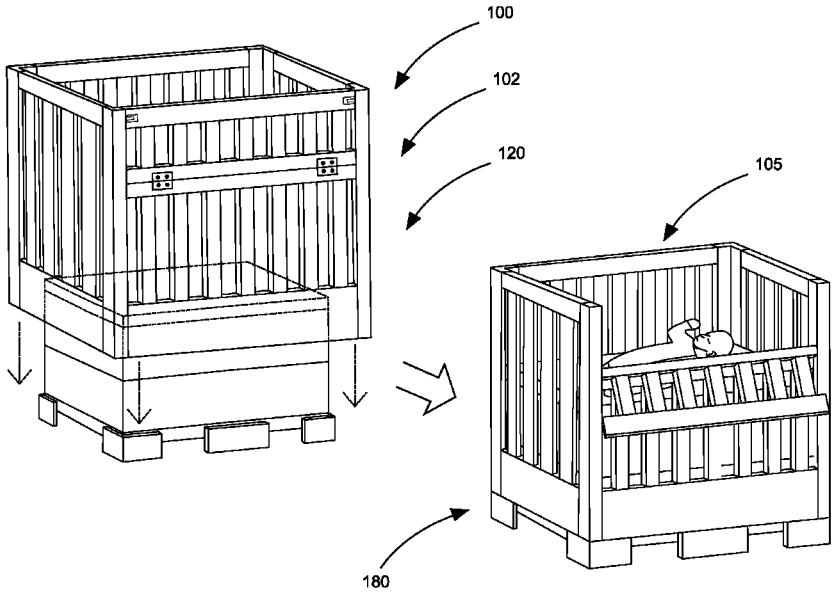
FIGS. 1A and 1B show perspective views illustrating a self-contained convertible bed and storage system in an in-use condition according to an embodiment of the present invention.
Figure 1B:
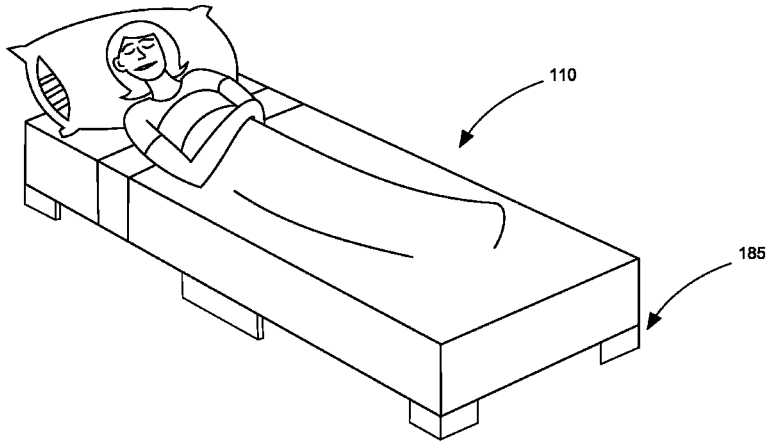

Referring now to the drawings by numerals of reference there is shown in FIGS. 1A and 1B perspective views illustrating self-contained convertible bed and storage system 100 in an in-use condition 120 according to an embodiment of the present invention.

Crib Transformer Bed 102 as self-contained convertible bed and storage system 100 preferably comprises: crib framework assembly 200; mattress platform assembly 400; and support system 375. In the present embodiment, crib framework assembly 200 and mattress platform assembly 400 may preferably be releasably attached one to another to form a multi-purpose changeable bed arrangement using latches, tongue and groove joints, mortise and tenon joints, or the like. Upon reading this specification, it should be appreciated that, under appropriate circumstances, considering such issues as user preferences, design preference, structural requirements, marketing preferences, cost, available materials, technological advances, etc., other connection and/or attachment arrangements such as, for example, pins, screws, dowels, dovetail joints, etc., may be sufficient. Those with ordinary skill in the art will now appreciate that upon reading this specification and by their understanding the art of structural joinery as described herein, methods of joining structural elements will be understood by those knowledgeable in such art.

Crib framework assembly 200 preferably comprises: four substantially vertical side panels including front panel 210, rear panel 215, right panel 220, and left panel 225; and four substantially upright posts including right front post 230, left front post 235, right rear post 240, and left rear post 245. Preferably, front panel 210, rear panel 215, right panel 220, and left panel 225, in combination, comprise crib framework assembly 200. The combination of these panels as shown in the present figure may preferably produce a rectangular configuration for crib framework assembly 200. In other embodiments, however, crib framework assembly 200 may assume a configuration of another shape such as spherical, elliptical, trapezoidal, or the like. In such cases, mattress platform assembly 400 and support system 375 may assume a configuration to match that of crib framework assembly 200.

Within the particular embodiment shown, each panel of crib framework assembly 200 may preferably comprise: at least one substantially horizontal upper rail 203; at least one substantially horizontal lower rail 205; and at least one, but preferably a plurality of, substantially vertical side slat(s) 207. Upper rail 203 of each side panel may be affixed to a proximal end of each side slat 207, and lower rail 205 may be affixed to a distal end of each side slat 207 such that upper rail 203 and lower rail 205 may be positioned parallel one to another and separated by side slat(s) 207. While front panel 210, rear panel 215, right panel 220, and left panel 225 of the present invention are described herein comprising a plurality of substantially vertical side slat(s) 207, these panels may alternatively comprise: a single pane, diagonal slats, slats of varying widths, etc. in lieu of dimensionally-identical substantially vertical side slat(s) 207 in order to meet the needs and/or requirements of consumers, safety agencies, or the like. Those with ordinary skill in the art will now appreciate that upon reading this specification and by their understanding the art of crib design as described herein, methods of designing crib framework panels will be understood by those knowledgeable in such art.

Preferably, the combination of right front post 230, left front post 235, right rear post 240, and left rear post 245 vertically supports the four substantially vertical side panels. Front panel 210, rear panel 215, right panel 220, and left panel 225 of crib framework assembly 200 are preferably each releasably attached to the upright posts of crib framework assembly 200 such that: front panel 210 is attached to and suspended between right front post 230 and left front post 235, rear panel 215 is attached to and suspended between right rear post 240 and left rear post 245, right panel 220 is attached to and suspended between right front post 230 and right rear post 240, and left panel 225 is attached to and suspended between left front post 235 and left rear post 245. These panels may be releasably attached to their corresponding posts by pocket-hole joinery, tongue and groove joints, mortise and tenon joints, or the like. Upon reading this specification, it should be appreciated that, under appropriate circumstances, considering such issues as user preferences, design preference, structural requirements, marketing preferences, cost, available materials, technological advances, etc., other connection and/or attachment arrangements such as, for example, latches, pins, screws, dowels, dovetail joints, etc., may be sufficient. Those with ordinary skill in the art will now appreciate that upon reading this specification and by their understanding the art of structural joinery as described herein, methods of joining structural elements will be understood by those knowledgeable in such art.

Self-contained convertible bed and storage system 100 preferably further comprises mattress platform assembly 400 having: right mattress frame 405; right base 430; left mattress frame 435; left base 460; right mattress tray 465; left mattress tray 470; right mattress 467; and left mattress 472. Right mattress frame 405 of the present invention may preferably comprise right fourfold sidewall system 407, whose confines may be defined by a substantially vertical right front sidewall 410; a substantially vertical right rear sidewall 415; a substantially vertical right outer sidewall 420; and a substantially vertical right inner sidewall 425. Likewise, left mattress frame 435 of the present invention may preferably comprise left fourfold sidewall system 437, whose confines may be defined by a substantially vertical left-front-sidewall 440; a substantially vertical left-rear-sidewall 445; a substantially vertical left-outer-sidewall 450; and a substantially vertical left-inner-sidewall 455. Right base 430 of mattress platform assembly 400 is preferably substantially horizontal and may be defined by inner surface 432, outer surface 434, and inner void 485. Similarly, left base 460 of mattress platform assembly 400 is preferably substantially horizontal and may be defined by inner facing 462, outer facing 464, and inner volume 480.

When mattress platform assembly 400 is collapsed for crib 105 use, right inner sidewall 425 and left-inner-sidewall 455 may preferably be hingably connected such that right inner sidewall 425 rests in planar alignment with left-inner-sidewall 455, and outer surface 434 of right base 430 may rest juxtaposed to outer facing 464 of left base 460. Alternatively, when mattress platform assembly 400 is expanded for bed 110 use, right inner sidewall 425 may rest juxtaposed to left-inner-sidewall 455, and outer surface 434 of right base 430 may rest in planar alignment with outer facing 464 of left base 460.

Right mattress 467 and left mattress 472 may preferably be releasably attached to right mattress tray 465 and left mattress tray 470, respectively, for use. Right mattress 467 and left mattress 472 are designed to provide comfort for a user resting thereon during use and may be made by various materials to that effect. Right mattress 467 and left mattress 472 may comprise springs, foam, cotton, or the like. Upon reading this specification, it should be appreciated that, under appropriate circumstances, considering such issues as user preferences, design preference, structural requirements, marketing preferences, cost, available materials, technological advances, etc., other mattress and/or bedding arrangements such as, for example, polyester, vinyl, down alternative, etc., may be sufficient.

Self-contained convertible bed and storage system 100 preferably further comprises support system 375. Support system 375 may preferably comprise front sidewall support 350; rear sidewall support 360; and corner-support-system 300. Corner-support-system 300 of the present embodiment may preferably comprise four 90-degree elements: right front corner support 305, right rear corner support 310, left front corner support 315, and left rear corner support 320. Front sidewall support 350 and rear sidewall support 360 may be linear in design to support the side panels of crib framework assembly 200 and the sidewalls of mattress platform assembly 400, as support system 375 supports crib framework assembly 200 and mattress platform assembly 400 above a ground surface. Those with ordinary skill in the art will now appreciate that upon reading this specification and by their understanding the art of structural support as described herein, methods of supporting a structural element will be understood by those knowledgeable in such art.

Figure 2A:
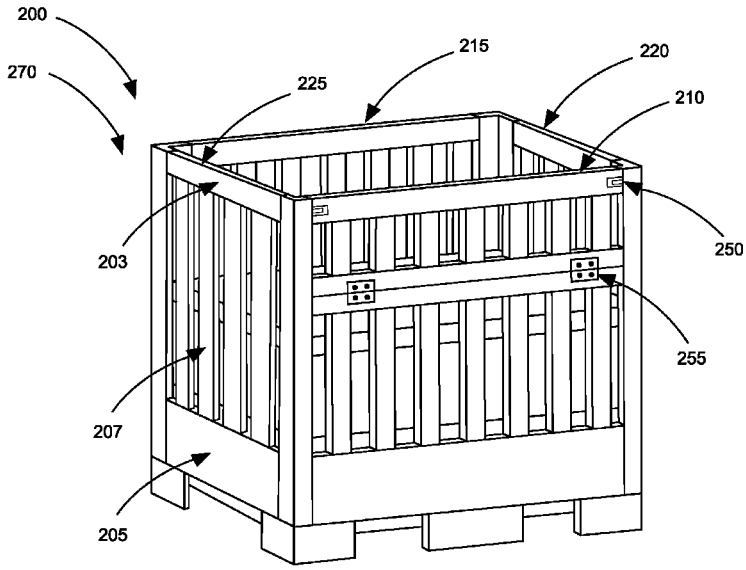
FIGS. 2A and 2B are perspective views illustrating the self-contained convertible bed and storage system according to an embodiment of the present invention of FIG. 1A.
Figure 2B:
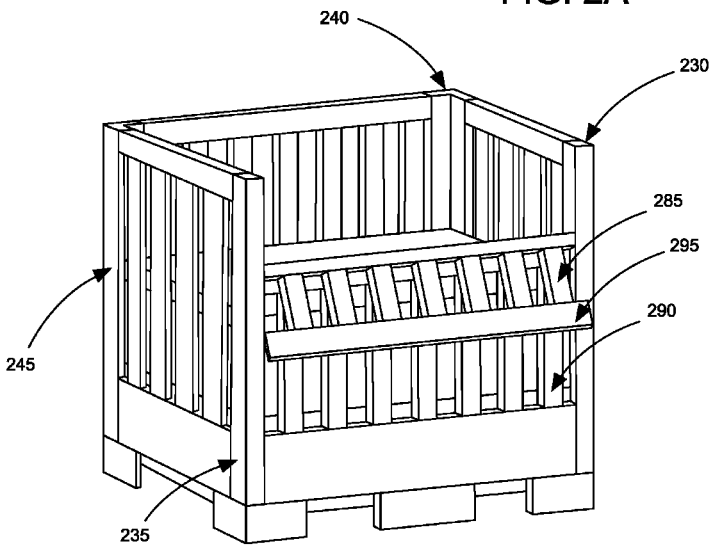

Referring now to FIGS. 2A and 2B, perspective views illustrating self-contained convertible bed and storage system 100 according to an embodiment of the present invention of FIG. 1A.

The present figure illustrates self-contained convertible bed and storage system 100 as crib 105 that may comprise crib framework assembly 200, mattress platform assembly 400, corner-support-system 300, front sidewall support 350, and rear sidewall support 360. In the present embodiment, mattress platform assembly 400 may preferably be collapsed into an assembly fit for crib 105 use. Crib framework assembly 200 may preferably encase collapsed mattress platform assembly 400 and be releasably attached thereto via at least one fastener 250. Crib framework assembly 200 may rest atop corner-support-system 300, front sidewall support 350, and/or rear sidewall support 360 individually or, preferably, in combination.

Front panel 210 of crib framework assembly 200 of the preferred embodiment may comprise upper member 285 and lower member 290. Upper member 285 may preferably be hingably attached about a horizontal axis to stationary lower member 290 by at least one hinge 255. Upper member 285 may be hingably attached to lower member 290 such that upper member 285 may act in a capacity of gate 295. For securing purposes, upper member 285, as gate 295, may preferably be releasably attached by at least one fastener 250 to right front post 230 and by at least one fastener 250 to left front post 235. Those with ordinary skill in the art will now appreciate that upon reading this specification and by their understanding the art of hinged-member anchoring as described herein, methods of securing and/or fastening hinged members will be understood by those knowledgeable in such art.

Figure 3:
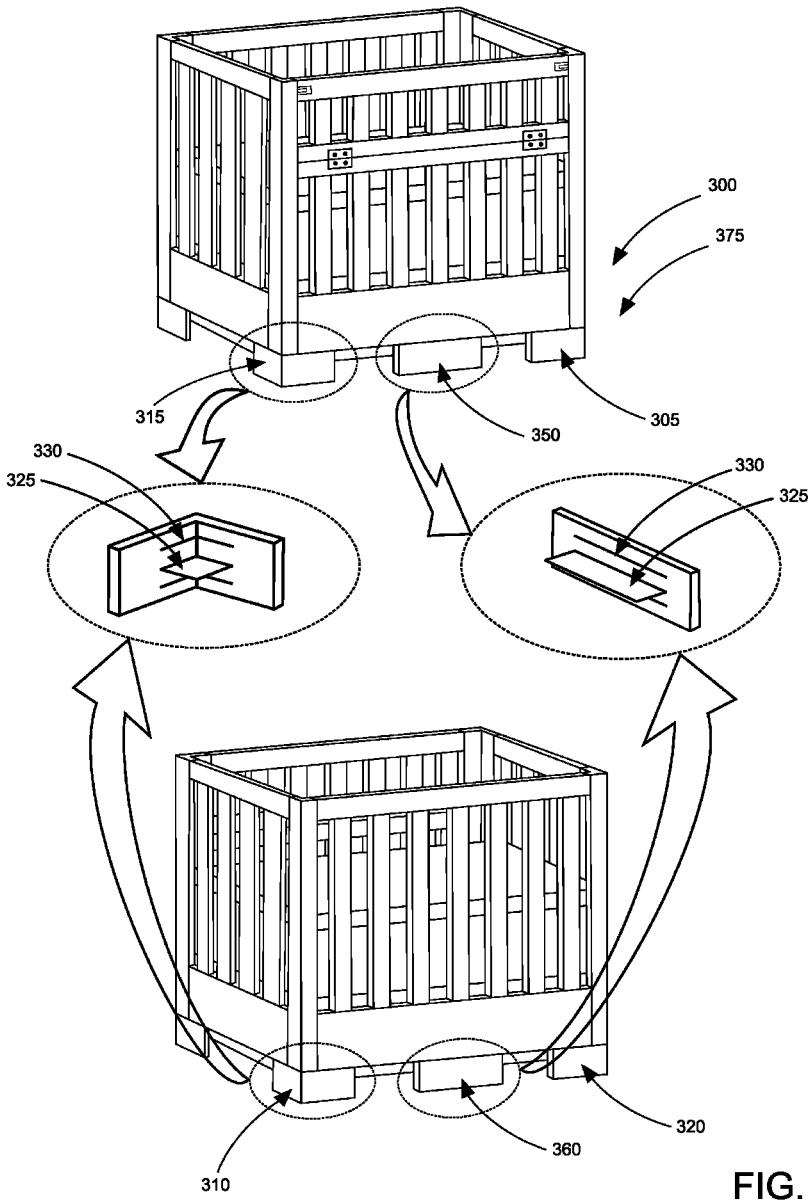
FIG. 3 is a perspective view illustrating the self-contained convertible bed and storage system with a support system according to an embodiment of the present invention of FIGS. 1A and 1B.

FIG. 3 is perspective view illustrating self-contained convertible bed and storage system 100 with support system 375 according to an embodiment of the present invention of FIGS. 1A and 1B.

Self-contained convertible bed and storage system 100 of the present invention may be height adjustable to meet the needs of a user. Right front corner support 305, right rear corner support 310, left front corner support 315, left rear corner support 320, front sidewall support 350, and rear sidewall support 360 each may preferably comprise at least one position-adjustable inner support shelf 325 and at least one, but preferably a plurality of, horizontal notch(es) 330. In the present embodiment, each notch 330 is preferably located along inner-facing surfaces of each component of support system 375, is preferably spaced at predetermined intervals from other notch(es) 330, and is preferably sized to accommodate at least one inner support shelf 325. Inner support shelf 325 and notch(es) 330 of left front corner support 315 and right rear corner support 310, as illustrated in the present figure, are typical of right front corner support 305, right rear corner support 310, left front corner support 315, and left rear corner support 320. As mattress platform assembly 400 may preferably be supported off a ground surface by resting atop at least one inner support shelf 325, the height of mattress platform assembly 400 may be determined by the position of inner support shelf 325. Those with ordinary skill in the art will now appreciate that upon reading this specification and by their understanding the art of shelving and structural support as described herein, methods of supporting a structural element will be understood by those knowledgeable in such art.

Figure 4A:
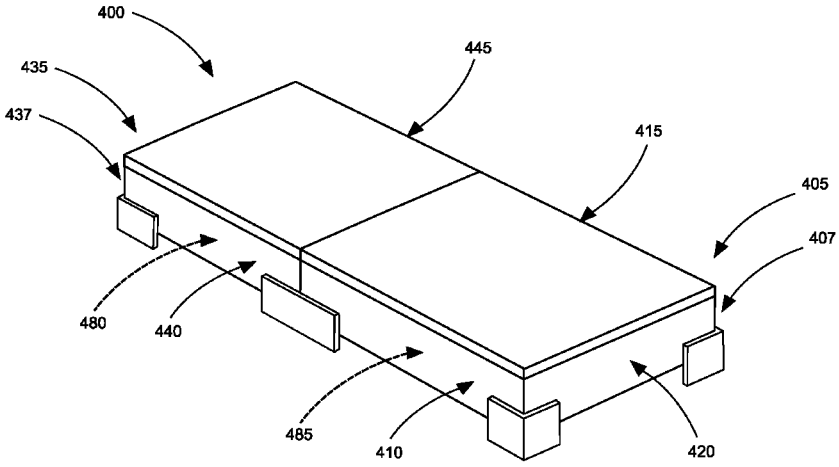
FIGS. 4A and 4B are perspective views illustrating the self-contained convertible bed and storage system as a bed and storage compartments according to an embodiment of the present invention of FIG. 1B.
Figure 4B:
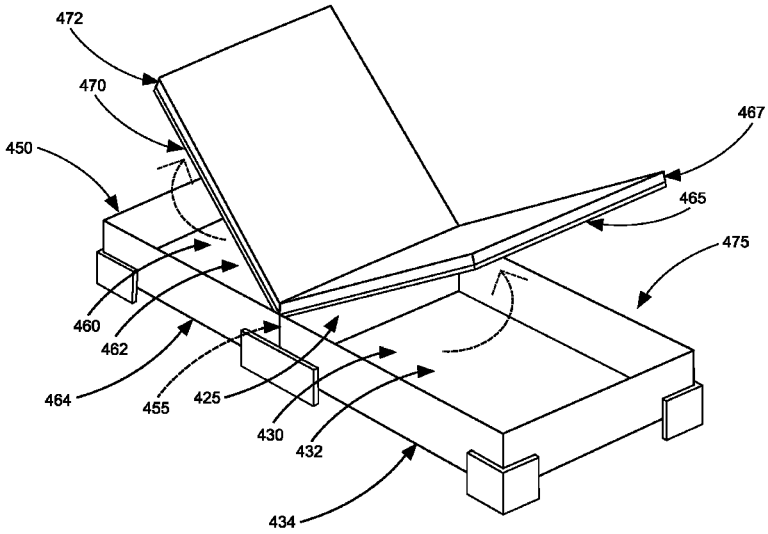

FIGS. 4A and 4B are perspective views illustrating self-contained convertible bed and storage system 100 as bed 110 and storage compartment(s) 475 according to an embodiment of the present invention of FIG. 1B.

In the present embodiment, mattress platform assembly 400, corner-support-system 300, front sidewall support 350, and rear sidewall support 360 may be arranged in combination to form bed 110. To accommodate this arrangement, mattress platform assembly 400 may be expanded into a form fit for bed 110 use. Ideally, mattress platform assembly 400 may be rest atop at least one inner support shelf 325 of corner-support-system 300, front sidewall support 350, and/or rear sidewall support 360, and may thereby be supported off a ground surface. Mattress platform assembly 400 may be releasably attached to at least one, but preferably all, elements of support system 375 (i.e.—right front corner support 305, right rear corner support 310, left front corner support 315, left rear corner support 320, front sidewall support 350, and rear sidewall support 360) by pins, screws, dowels, or the like. Upon reading this specification, it should be appreciated that, under appropriate circumstances, considering such issues as user preferences, design preference, structural requirements, marketing preferences, cost, available materials, technological advances, etc., other connection and/or attachment arrangements such as, for example, pocket-hole joinery, tongue and groove joints, mortise and tenon joints latches, dovetail joints, etc., may be sufficient. Those with ordinary skill in the art will now appreciate that upon reading this specification and by their understanding the art of structural joinery as described herein, methods of joining structural elements will be understood by those knowledgeable in such art.

Inner void 485 and inner volume 480 of mattress platform assembly 400 preferably act in a capacity of storage compartment(s) 475. These storage compartment(s) 475 may be used for the storage of storable items such as extra bedding, clothes, toys, and the like. Right mattress tray 465 and left mattress tray 470 may preferably rest atop right mattress frame 405 and left mattress frame 435, respectively, and thereby effectively cover inner void 485 and inner volume 480, respectively, in the capacity of a lid. Furthermore, right mattress tray 465 and left mattress tray 470 may preferably be hingably attached to right inner sidewall 425 of right mattress frame 405 and left-inner-sidewall 455 of left mattress frame 435, respectively, such that the lifting of right mattress tray 465 may allow access to inner void 485 as storage compartment 475, and the lifting of left mattress tray 470 may allow access to inner volume 480 as storage compartment 475. In certain embodiments, mattress platform assembly 400 may comprise support arms, tension rods, spring hinges, or the like to be used to assist a user in raising and propping-up right mattress tray 465 and/or left mattress tray 470 when accessing storage compartment(s) 475. Those with ordinary skill in the art will now appreciate that upon reading this specification and by their understanding the art of structural support as described herein, methods of raising and supporting a structural element will be understood by those knowledgeable in such art.

In order to provide comfortable resting surfaces for a user, right mattress 467 and left mattress 472 may preferably be releasably attached to right mattress tray 465 and left mattress tray 470, respectively, by such attachment means as hook-and-loop fasteners, snaps, and the like. Upon reading this specification, it should be appreciated that, under appropriate circumstances, considering such issues as user preferences, design preference, structural requirements, marketing preferences, cost, available materials, technological advances, etc., other attachment and/or fastening arrangements such as, for example, hooks, bolts, elastic, etc., may be sufficient.

Preferably designed to withstand years of use by children and adults alike, self-contained convertible bed and storage system 100 may be constructed of wood, with a plurality of finishes and colors available such that self-contained convertible bed and storage system 100 may fit into various home decoration motifs and encourage a child to interact with and be entertained by self-contained bed and storage system 100. Upon reading this specification, it should be appreciated that, under appropriate circumstances, considering such issues as user preferences, design preference, structural requirements, marketing preferences, cost, available materials, technological advances, etc., other structural material arrangements such as, for example, plastic, metal, wood composite, etc., may be sufficient. For purposes of durability and strength, fastener(s) 250, hinge(s) 255, and/or any other such attachment means or fixtures may preferably comprise stainless steel. Upon reading this specification, it should be appreciated that, under appropriate circumstances, considering such issues as user preferences, design preference, structural requirements, marketing preferences, cost, available materials, technological advances, etc., other fixtures and/or attachment arrangements such as, for example, connecting posts, latches, hook-and-eye closures, pins, etc., may be sufficient.

Self-contained convertible bed and storage system 100 may be sold as kit 270 comprising the following parts: at least one crib framework assembly 200; at least one mattress platform assembly 400; at least one support system 375; and at least one set of user instructions. Self-contained convertible bed and storage system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
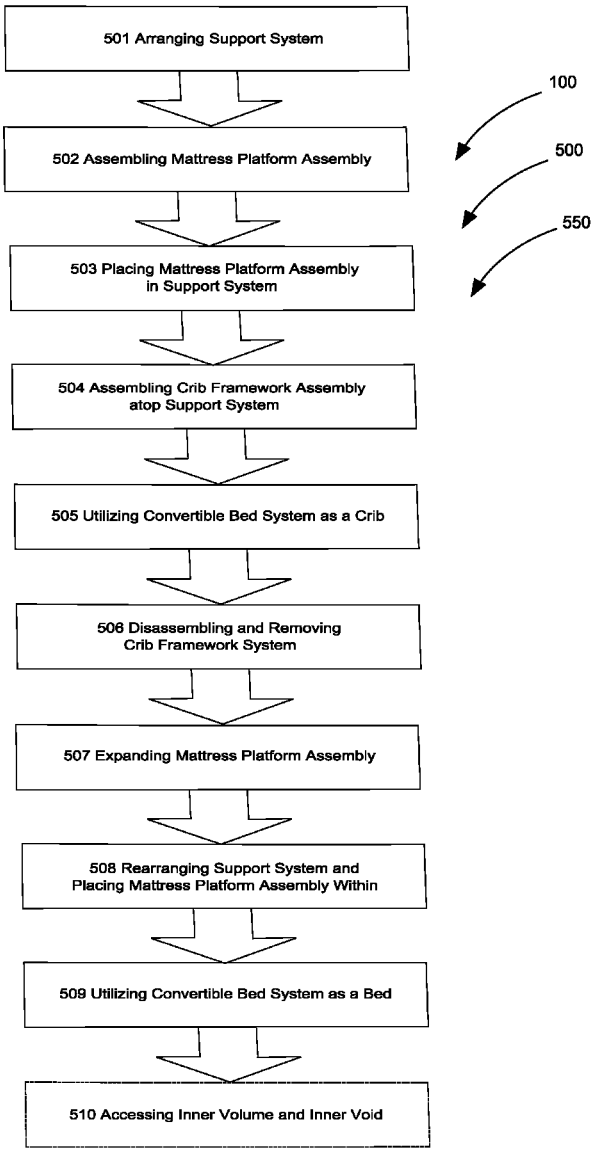
FIG. 5 is a flowchart illustrating a method of use for the self-contained convertible bed and storage system according to an embodiment of the present invention of FIGS. 1A-4B.

FIG. 5 is flowchart 550 illustrating method of use 500 for self-contained convertible bed and storage system 100 according to an embodiment of the present invention of FIGS. 1A-4B.

A method of using (at least hereby enabling method of use 500) a self-contained convertible bed and storage system 100 preferably comprises the steps of: step one 501 arranging corner-support-system 300, front sidewall support 350, and rear sidewall support 360; step two 502 assembling mattress platform assembly 400; step three 503 placing mattress platform assembly 400 within support system arrangement 180; step four 504 assembling crib framework assembly 200 atop support system arrangement 180; step five 505 utilizing self-contained convertible bed and storage system 100 as crib 105; step six 506 disassembling crib framework assembly 200 and removing from support system arrangement 180; step seven 507 expanding mattress platform assembly 400; step eight 508 rearranging support system arrangement 180 into new arrangement 185 and placing mattress platform assembly 400 within new arrangement 185; and step nine 509 utilizing self-contained convertible bed and storage system 100 as bed 110. The method of use 500 preferably further comprises step ten 510 accessing inner volume 480 and inner void 485 as needed for storing storable items.

It should be noted that step ten 510 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A self-contained convertible bed and storage system comprising:

a crib framework assembly including;
- four substantially vertical side panels including;
  - a front panel;
  - a rear panel;
  - a right panel; and
  - a left panel;
- four substantially upright posts including;
  - a right front post;
  - a left front post;
  - a right rear post; and
  - a left rear post;

a mattress platform assembly including;
- a right mattress frame including a right fourfold sidewall system comprising;
  - a substantially vertical right front sidewall;
  - a substantially vertical right rear sidewall;
  - a substantially vertical right outer sidewall;
  - a substantially vertical right inner sidewall;
- a substantially horizontal right base having an inner surface, an outer surface, and an inner void;
- a left mattress frame including a left fourfold sidewall system comprising;
  - a substantially vertical left-front-sidewall;
  - a substantially vertical left-rear-sidewall;
  - a substantially vertical left-outer-sidewall;
  - a substantially vertical left-inner-sidewall;
- a substantially horizontal left base having an inner facing and an outer facing, and an inner volume;
- a right mattress tray and a left mattress tray; and
- a right mattress and a left mattress;

a support system including;
- a fourfold corner-support-system comprising;
  - a right front corner support;
  - a right rear corner support;
  - a left front corner support; and
  - a left rear corner support;
- a front sidewall support; and
- a rear sidewall support;

wherein said front panel; said rear panel; said right panel; and said left panel in combination comprise said crib framework assembly;

wherein said right front post; said left front post; said right rear post; and said left rear post in combination vertically support said substantially vertical side panels;

wherein said mattress platform assembly comprises said right mattress frame, said substantially horizontal right base, said left mattress frame, and said substantially horizontal left base in combination;

wherein said substantially vertical right front sidewall; said substantially vertical right rear sidewall; said substantially vertical right outer sidewall; and said substantially vertical right inner sidewall define said right fourfold sidewall system of said right mattress frame;

wherein said inner surface, said outer surface, and said inner void define said substantially horizontal right base;

wherein said a substantially vertical left-front-sidewall; said substantially vertical left-rear-sidewall; said substantially vertical left-outer-sidewall; and said substantially vertical left-inner-sidewall define confines of said left fourfold sidewall system;

wherein said inner facing and said outer facing; and said inner volume form said substantially horizontal left base;

wherein said right mattress tray and said left mattress tray hold said right mattress and said left mattress, respectively, for use;

wherein said right mattress and said left mattress provide comfort for a user resting thereon during use;

wherein said four substantially vertical side panels of said crib framework assembly each comprise; at least one substantially horizontal upper rail; at least one substantially horizontal lower rail; and a plurality of substantially vertical side slats used to frame said crib framework assembly;

wherein said upper rail of each said substantially vertical side panel is affixed to a proximal end of each said side slat of said substantially vertical side panel and said lower rail of each said substantially vertical side panel is affixed to a distal end of each said side slat of said substantially vertical side panel such that said upper rail and said lower rail are positioned parallel one to another;

wherein said substantially vertical side panels of said crib framework assembly are each releasably attached to said upright posts of said crib framework assembly such that said front panel is attached to and suspended between said right front post and said left front post; said rear panel is attached to and suspended between said right rear post and said left rear post; said right panel is attached to and suspended between said right front post and said right rear post; and said left panel is attached to and suspended between said left front post and said left rear post; and wherein said crib framework assembly and said mattress platform assembly are releasably attached one to another to form a multi-purpose changeable bed arrangement.

2. The self-contained convertible bed and storage system of claim 1 wherein said crib framework assembly, said mattress platform assembly, said corner-support-system, said front sidewall support, and said rear sidewall support may be arranged to form a crib.

3. The self-contained convertible bed and storage system of claim 2 wherein said mattress platform assembly, said corner-support-system, said front sidewall support, and said rear sidewall support may be arranged to form a bed.

4. The self-contained convertible bed and storage system of claim 3 wherein said mattress platform assembly may be collapsed into an assembly fit for crib use and may be expanded into a form fit for bed use.

5. The self-contained convertible bed and storage system of claim 4 wherein said crib framework assembly encases collapsed said mattress platform assembly, is releasably attached thereto via at least one fastener; and rests atop said corner-support-system, said front sidewall support, and said rear sidewall support.

6. The self-contained convertible bed and storage system of claim 5 wherein said mattress platform assembly is height adjustable.

7. The self-contained convertible bed and storage system of claim 1 wherein said right front corner support, said right rear corner support, said left front corner support, said left rear corner support, said front sidewall support, and said rear sidewall support each comprise at least one position-adjustable inner support shelf.

8. The self-contained convertible bed and storage system of claim 7 wherein said right front corner support, said right rear corner support, said left front corner support, said left rear corner support, said front sidewall support, and said rear sidewall support each comprise a plurality of notches along inner-facing surfaces which are spaced at predetermined intervals and are sized to accommodate at least one said inner support shelf.

9. The self-contained convertible bed and storage system of claim 8 wherein said mattress platform assembly is supported off a ground surface by at least one said inner support shelf of said corner-support-system, said front sidewall support, and said rear sidewall support.

10. The self-contained convertible bed and storage system of claim 1 wherein said front panel of said crib framework assembly comprises an upper member and a lower member such that said upper member is hingably attached about a horizontal axis to stationary said lower member, whereby said upper member acts in a capacity of a gate and is releasably attachable to said right front post and said left front post.

11. The self-contained convertible bed and storage system of claim 1 wherein said right inner sidewall and said left inner sidewall are hingably connected such that said right inner sidewall rests in planar alignment with said left inner sidewall when said mattress platform assembly is collapsed; said right inner sidewall rests juxtaposed to said left inner sidewall when said mattress platform assembly is expanded; said outer surface of said right base rests juxtaposed to said outer facing of said left base when said mattress platform is collapsed; and said outer surface of said right base rests in planar alignment with said outer facing of said left base when said mattress platform is expanded.

12. The self-contained convertible bed and storage system of claim 1 wherein said right mattress and said left mattress are releasably attached to said right mattress tray and said left mattress tray, respectively.

13. The self-contained convertible bed and storage system of claim 1 wherein said inner void and said inner volume act in a capacity of storage compartments.

14. The self-contained convertible bed and storage system of claim 13 wherein said mobile right mattress tray and said left mattress tray are hingably connected to said right inner sidewall and said left inner sidewall, respectively, such that the lifting of said right mattress tray allows access to said inner void and the lifting of said left mattress tray allows access to said inner volume.

15. The self-contained convertible bed and storage system of claim 1 wherein said crib framework assembly, said mattress platform assembly, said corner-support-system, said front sidewall support, and said rear sidewall support comprise wood.

16. The self-contained convertible bed and storage system of claim 1 wherein said wood comprises a plurality of finishes and colors such that a child is entertained and encouraged to interact with said self-contained convertible bed and storage system.

17. The self-contained convertible bed and storage system of claim 1 wherein said fasteners, said hinges comprise stainless steel.

18. A self-contained convertible bed and storage system comprising:

a crib framework assembly including;

four substantially vertical side panels including;

a front panel;

a rear panel;

a right panel; and a left panel;

four substantially upright posts including;
a right front post;
a left front post;
a right rear post; and
a left rear post;

a mattress platform assembly including;
a right mattress frame including a right fourfold sidewall system comprising;
a substantially vertical right front sidewall;
a substantially vertical right rear sidewall;
a substantially vertical right outer sidewall;
a substantially vertical right inner sidewall;
a substantially horizontal right base having an inner surface, an outer surface, and an inner void;
a left mattress frame including a left fourfold sidewall system comprising;
a substantially vertical left-front-sidewall;
a substantially vertical left-rear-sidewall;
a substantially vertical left-outer-sidewall;
a substantially vertical left-inner-sidewall;
a substantially horizontal left base having an inner facing and an outer facing, and an inner volume;
a right mattress tray and a left mattress tray; and
a right mattress and a left mattress;

a support system including;
a fourfold corner-support-system comprising;
a right front corner support;
a right rear corner support;
a left front corner support; and
a left rear corner support;
a front sidewall support; and
a rear sidewall support;

wherein said front panel; said rear panel; said right panel; and said left panel in combination comprise said crib framework assembly;

wherein said right front post; said left front post; said right rear post; and said left rear post in combination vertically support said substantially vertical side panels;

wherein said mattress platform assembly comprises said right mattress frame, said substantially horizontal right base, said left mattress frame, and said substantially horizontal left base in combination;

wherein said substantially vertical right front sidewall; said substantially vertical right rear sidewall; said substantially vertical right outer sidewall; and said substantially vertical right inner sidewall define said right fourfold sidewall system of said right mattress frame;

wherein said inner surface, said outer surface, and said inner void define said substantially horizontal right base;

wherein said a substantially vertical left-front-sidewall; said substantially vertical left-rear-sidewall; said substantially vertical left-outer-sidewall; and said substantially vertical left-inner-sidewall define confines of said left fourfold sidewall system;

wherein said inner facing and said outer facing; and said inner volume form said substantially horizontal left base;

wherein said right mattress tray and said left mattress tray hold said right mattress and said left mattress for use;

wherein said right mattress and said left mattress provide comfort for a user resting thereon during use;

wherein said four substantially vertical side panels of said crib framework assembly each comprise; at least one substantially horizontal upper rail; at least one substantially horizontal lower rail; and a plurality of substantially vertical side slats used to frame said crib framework assembly;

wherein said upper rail of each said substantially vertical side panel is affixed to a proximal end of each said side slat of said substantially vertical side panel and said lower rail of each said substantially vertical side panel is affixed to a distal end of each said side slat of said substantially vertical side panel such that said upper rail and said lower rail are positioned parallel one to another;

wherein said substantially vertical side panels of said crib framework assembly are each releasably attached to said upright posts of said crib framework assembly such that said front panel is attached to and suspended between said right front post and said left front post; said rear panel is attached to and suspended between said right rear post and said left rear post; said right panel is attached to and suspended between said right front post and said right rear post; and said left panel is attached to and suspended between said left front post and said left rear post;

wherein said crib framework assembly and said mattress platform assembly are releasably attached one to another to form a multi-purpose changeable bed arrangement;

wherein said crib framework assembly, said mattress platform assembly, said corner-support-system, said front sidewall support, and said rear sidewall support may be arranged to form a crib;

wherein said mattress platform assembly may be collapsed into an assembly fit for crib use;

wherein said front panel of said crib framework assembly comprises an upper member hingably attached to a lower member such that said upper member acts in a capacity of a gate; and wherein said right front corner support, said right rear corner support, said left front corner support, said left rear corner support, said front sidewall support, and said rear sidewall support each comprise at least one position-adjustable inner support shelf and a plurality of corresponding inner support shelf notches, thereby making mattress platform assembly height-adjustable as it is supported off a ground surface by at least one said inner support shelf.

19. A method of using a self-contained convertible bed and storage system comprising the steps of:

arranging a corner-support-system, a front sidewall support, and a rear sidewall support;

assembling a mattress platform assembly;

placing said mattress platform assembly within a support system arrangement;

assembling a crib framework assembly atop said support system arrangement;

utilizing said self-contained convertible bed and storage system as a crib;

disassembling said crib framework assembly and removing from said support system arrangement;

expanding said mattress platform assembly;

rearranging said support system arrangement and placing said mattress platform assembly within a new arrangement; and utilizing said self-contained convertible bed and storage system as a bed.

20. The method of claim 19 further comprising the step of accessing an inner volume and an inner void as needed for storing storable items.

* * * * *